US006282296B1

(12) United States Patent
Konno et al.

(10) Patent No.: US 6,282,296 B1
(45) Date of Patent: Aug. 28, 2001

(54) AUDIO REPRODUCING APPARATUS

(75) Inventors: Fumiyasu Konno, Osaka; Akinori Hasegawa, Hyogo; Masahide Onishi, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/292,161

(22) Filed: Apr. 15, 1999

(30) Foreign Application Priority Data

Apr. 15, 1998 (JP) ..... 10-104482

(51) Int. Cl.[7] ..... H04R 3/00; H04R 29/00
(52) U.S. Cl. ..... 381/96; 381/56; 381/57
(58) Field of Search ..... 381/56, 57–8, 381/59, 91, 92, 93, 95, 96, 102, 104, 107, 108, 109, 111, 120–122, 86

(56) References Cited

U.S. PATENT DOCUMENTS 4,254,303 * 3/1981 Takizawa ..... 381/107
4,628,526 * 12/1986 Germer ..... 381/108
4,864,246 * 9/1989 Kato et al. ..... 381/107
5,107,539 * 4/1992 Kato et al. ..... 381/57
5,434,926 * 7/1995 Watanabe et al. ..... 381/108
5,896,450 * 4/1999 Kurihara ..... 381/57
6,122,385 * 9/2000 Konno et al. ..... 381/59

FOREIGN PATENT DOCUMENTS 53-108419 * 9/1978 (JP) ..... 381/92
63-82197 * 4/1988 (JP) ..... 381/92
1-29154 * 1/1989 (JP) ..... 381/57

* cited by examiner

*Primary Examiner*—Xu Mei
(74) *Attorney, Agent, or Firm*—Ratner & Prestia

(57) ABSTRACT

An audio reproducing apparatus is utilized in noisy environment in which noise level greatly varies. The apparatus includes first and second microphones placed respectively inside and outside a speaker box. Outputs of respective microphones are filtered, and then added with each other so that signals proportional to outside noise can be extracted. A gain of variable gain circuit can be changed with these extracted signals, whereby sound can be reproduced in noisy environments.

8 Claims, 4 Drawing Sheets

AUDIO REPRODUCING APPARATUS

FIELD OF THE INVENTION

The present invention relates to an audio reproducing apparatus that can excellently reproduce signals even at a noisy place such as a factory and transportation means including cars and trains.

BACKGROUND OF THE INVENTION

There are a lot of opportunities to reproduce audio signals at a noisy place, where a noise level is high and varies, such as a factory, and transportation means including cars and trains.

FIG. 6 is a block diagram illustrating a conventional audio reproducing apparatus that is utilized in a noisy environment. In FIG. 6, an audio signal received at input terminal 1 travels through variable gain circuit 2 and is amplified by power amplifier 3. An output signal tapped off from amplifier 3 is fed into speaker unit 5 disposed in speaker box 4, thereby reproducing the signal into audio form.

Microphone 6 disposed around speaker unit 5 collects the sum of the signals which speaker unit 5 radiates and noises around speaker box 4. An output signal supplied from microphone 6 together with the output signal from amplifier 3 are fed into subtractor 7.

Subtractor 7 subtracts an input signal component from the sum of the signal radiated from speaker unit 5 and the noises around speaker box 4 so that an output signal proportional to the surrounding noise is extracted. The output signal supplied from subtractor 7 runs through low pass filter 8 where a frequency band of the signal is limited, and then runs through rectifier 9 where the output signal is converted into direct current (dc), which then is fed into variable gain circuit 2.

Because variable gain circuit 2 is automatically controlled its amplifying rate by the output signal supplied from subtractor 7, speaker unit 5 can radiate signals free from being cancelled by the surrounding noise, i.e. free from being masked. As already discussed, the output signal supplied from subtractor 7 varies proportionally to the surrounding noise, which contributes to this automatic controlling.

However, in the conventional audio reproducing apparatus utilized in the noisy environment, differences exist between the audio signals supplied from speaker unit 5 and the output signals supplied from amplifier 3 so that subtractor 7 cannot completely remove the radiated signal from speaker unit 5. Therefore, it is difficult to extract only the noises around speaker box 4, and a user is thus obliged to control variable gain circuit 2 within a narrowly limited frequency band. The conventional audio reproducing apparatus utilized in a noisy environment thus has not been provided with a sufficient masking correction.

SUMMARY OF THE INVENTION

The audio reproducing apparatus of the present invention comprises the following:

(a) a power amplifier;

(b) a speaker box including a speaker unit which reproduces output signals from the power amplifier;

(c) a first microphone disposed outside the speaker box;

(d) a second microphone disposed inside the speaker box;

(e) a low pass filter (LPF) coupled to the first microphone;

(f) a high pass filter (HPF) coupled to the second microphone;

(g) an adder for adding an output from the LPF and an output from the HPF;

(h) an ac/dc converter for converting an ac output signal to a dc output signal; and (i) a variable gain circuit disposed at an input side of the power amplifier, and an output signal of the circuit being varied responsive to a level of the dc output signal supplied from the ac/dc converter.

A gain of the variable gain circuit is changed by the output signal of the adder so that the better masking correction responsive more faithfully to the surrounding noise can be achieved.

DETAILED DESCRIPTION OF THE PREFERRED EMBODIMENT

A preferred embodiment of the present invention is described hereinafter with reference to the accompanying drawings.

Figure 1:
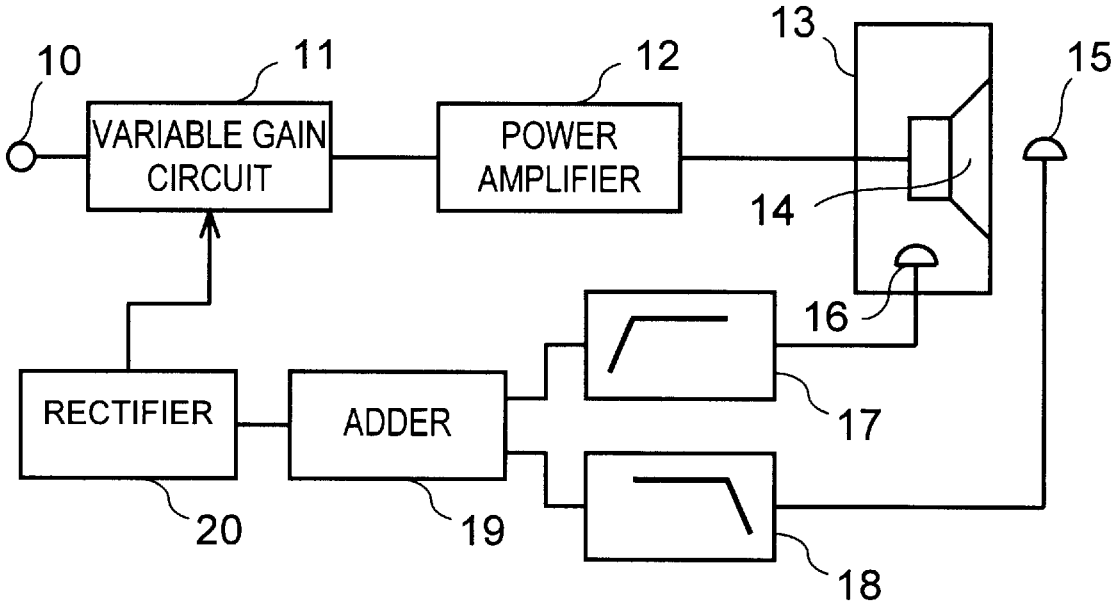
FIG. 1 is a block diagram illustrating an audio reproducing apparatus in accordance with an exemplary embodiment of the present invention.

FIG. 1 is a block diagram of an audio reproducing apparatus of the present invention. In FIG. 1, a signal received at input terminal 10 is fed into variable gain circuit 11, which is controlled by a signal responsive to surrounding noise. An output signal supplied from variable gain circuit 11 is fed into power amplifier 12, which outputs a signal to speaker unit 14 disposed in speaker box 13.

First microphone 15 disposed in front of speaker unit 14 collects audio signals radiated from speaker unit 14 and the surrounding noise. Further, second microphone 16 is disposed behind speaker unit 14 in speaker box 13. Second microphone 16 dedicates itself to collecting the audio signals radiated from speaker unit 14.

Figure 2:
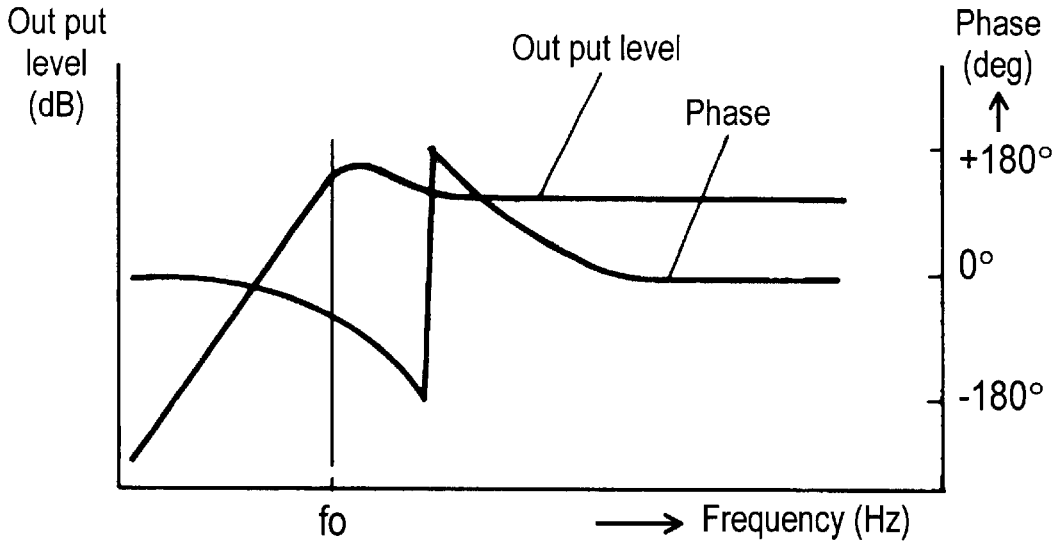
FIG. 2 shows output characteristics of a first microphone employed in the audio reproducing apparatus of FIG. 1.
Figure 3:
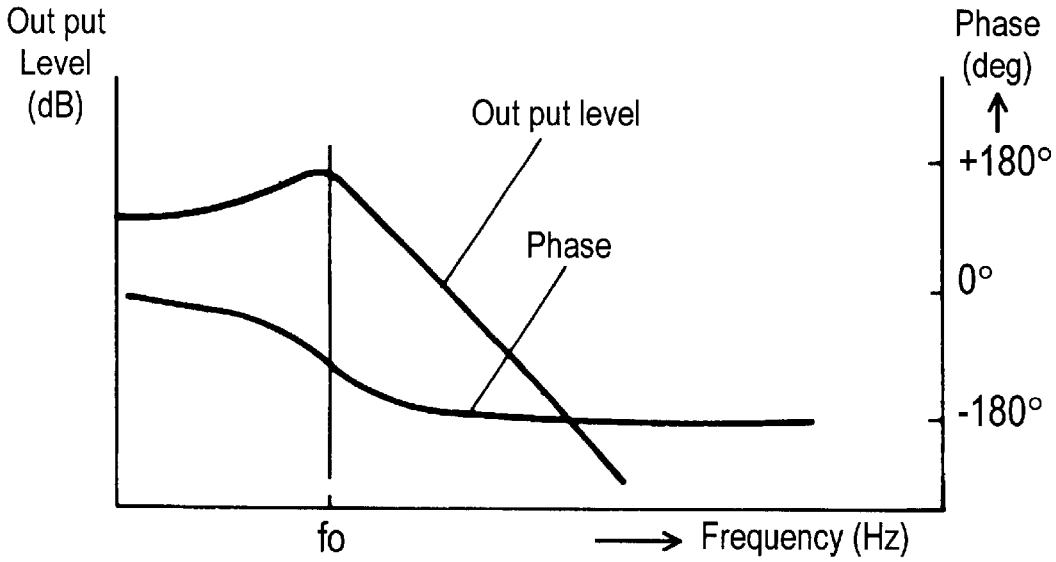
FIG. 3 shows output characteristics of a second microphone employed in the audio reproducing apparatus of FIG. 1.

FIG. 2 shows transfer frequency of the output signal supplied from first microphone 15 with regard to the output signal from power amplifier 12, and phase characteristics of the frequency. As FIG. 2 indicates, a level of the signal radiated from speaker unit 14 shows a characteristic similar to that of a quadratic high pass filter (HPF). FIG. 3 shows transfer frequency of the output signal supplied from second microphone 16 disposed in speaker box 13 with regard to the output signal from power amplifier 12, and phase characteristics of the frequency. As FIG. 3 indicates, a level of the signal radiated from speaker unit 14 shows a characteristic similar to that of a quadratic low pass filter (LPF).

As such, each output signal supplied from first and second microphones 15 and 16 is similar to respective signals passed through HPF and LPF which have the minimum resonant frequency (fo) of the speaker unit in common.

Then, quadratic HPF 17 and quadratic LPF 18 which have cut-off frequencies adjusted to the frequency of the minimum resonance frequency of speaker unit 14 are prepared. Next, an output of first microphone 15 is coupled to quadratic LPF 18, and an output of second microphone 16 is coupled to quadratic HPF 17.

Figure 4:
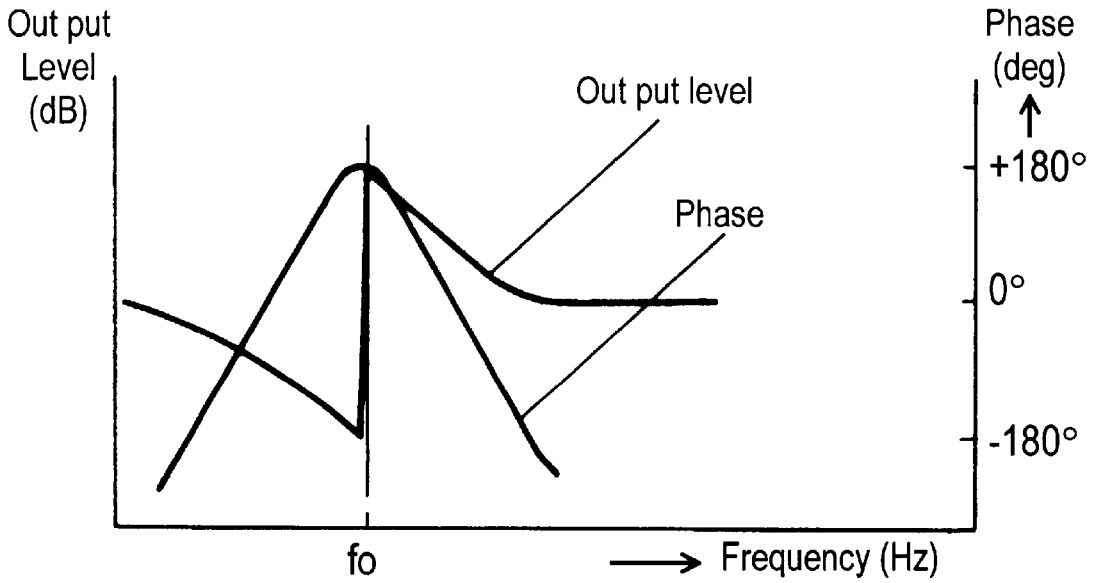
FIG. 4 shows output characteristics of a low pass filter employed in the audio reproducing apparatus of FIG. 1.
Figure 5:
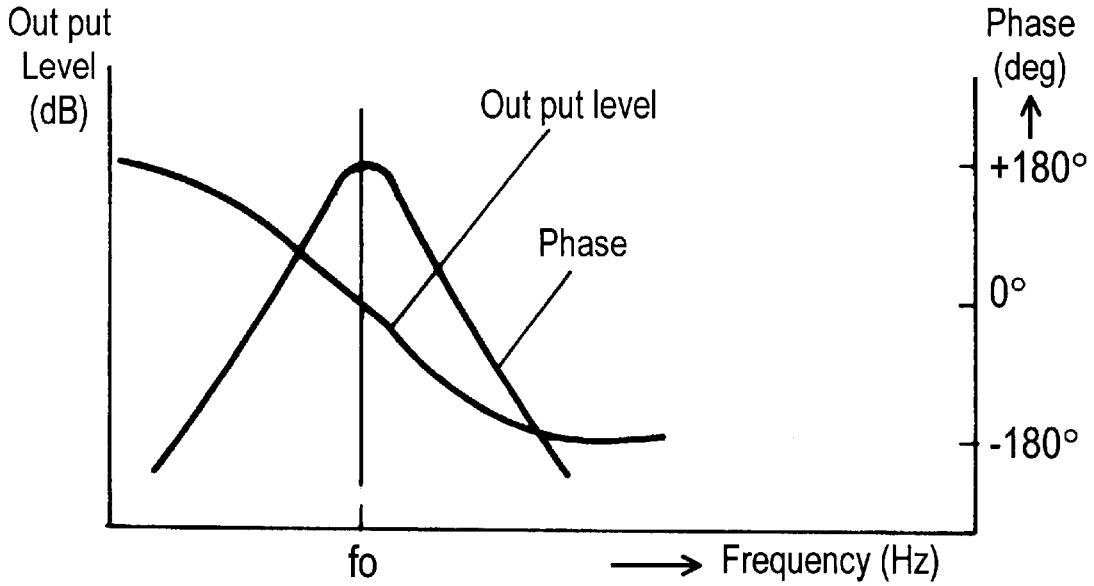
FIG. 5 shows output characteristics of a high pass filter employed in the audio reproducing apparatus of FIG. 1.
Figure 6:
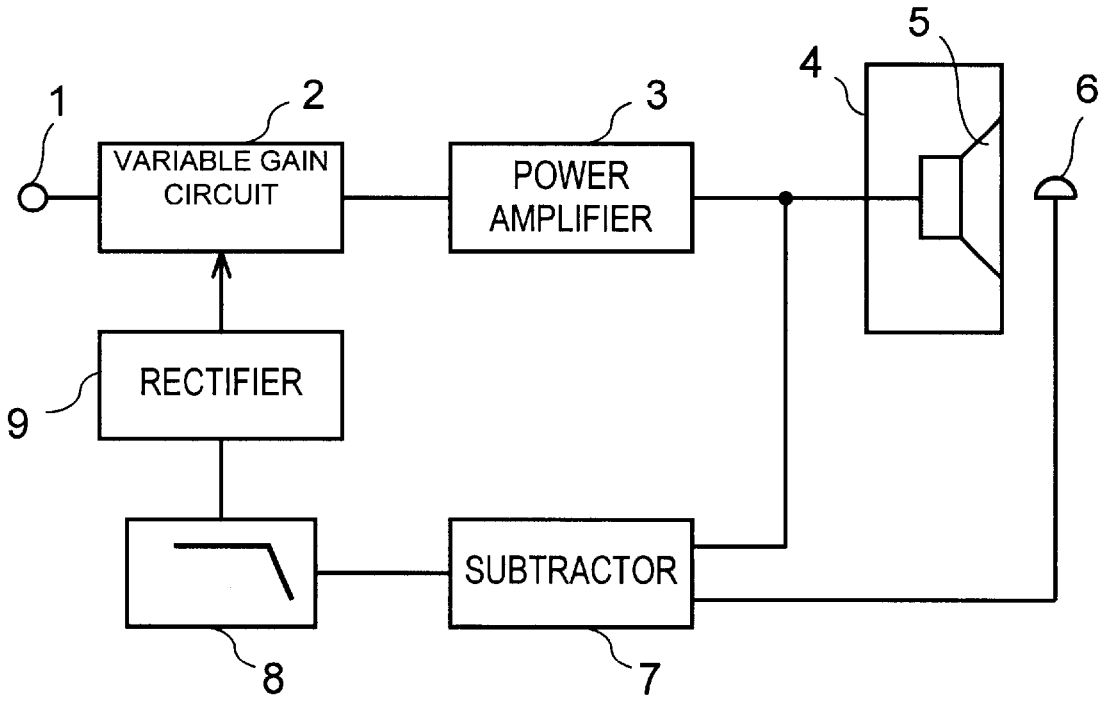
FIG. 6 is a block diagram of a conventional audio reproducing apparatus.

As a result, an output frequency and a phase characteristic of the output signal of first microphone 15 passed through quadratic LPF 18 have almost the same band pass characteristics as those of second microphone 16 passed through quadratic HPF 17. These situations are illustrated in FIG. 4 and FIG. 5.

Respective first and second microphones 15 and 16 are disposed at the front and rear with regard to speaker unit 14. The signal phases supplied from both the microphones form reverse phases with each other.

When adder 19 adds an output signal from filter 18 to an output signal from filter 17, the signal component radiated from speaker unit 14 is removed so that only the surrounding noise collected by first microphone 15 can be extracted.

An AC signal supplied from adder 19 and proportional to the surrounding noise is converted to a DC signal by rectifier 20, and then is applied to variable gain circuit 11. Then an amplifying rate of variable gain circuit 11 varies, which realizes an automatic gain control responsive to the noise around the speaker. As a result, a better masking correction faithful to the surrounding noise can be achieved.

In the exemplary embodiment described above, first and second microphones 15 and 16 are disposed outside and inside the speaker box 13, and reproduction signals by the speaker form reverse phases viewed from the speaker unit 14. However, the reproduction signals by the speaker viewed from speaker unit 14 do not necessarily form a precise reverse phase. In this case, electrically-reverse-phase-relation can be established by a circuit structure of the quadratic LPF 18 and HPF 17, thereby producing the same effect as in the above-described embodiment.

As described above, according to the present invention, two microphones are disposed inside and outside the speaker box respectively, and respective outputs thereof are filtered so that the signal component supplied from the speaker unit can be removed. Only the outside noise can be thus collected, and the output of the speaker can be varied responsive to the surrounding noise.

The embodiment discussed above described the apparatus which automatically controls the gain of the variable gain circuit. The gain, however, is not always automatically controlled. For example, the surrounding noise level is displayed so that the gain can be manually controlled.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An audio reproducing apparatus comprising:

(a) a power amplifier;

(b) a speaker unit which reproduces output signals from said power amplifier, said speaker unit having a minimum resonance frequency;

(c) a first microphone;

(d) a second microphone;

(e) a low pass filter coupled to said first microphone, said low pass filter having a first cut-off frequency which is based on said minimum resonance frequency of said speaker unit;

(f) a high pass filter coupled to said second microphone, said high pass filter having a second cut-off frequency which is based on said minimum resonance frequency of said speaker unit;

(g) an adder for adding an output from said low pass filter and an output from said high pass filter to obtain an adder result;

(h) a variable gain circuit providing an output signal to an input side of said power amplifier, said output signal being varied responsive to said adder result.

2. An audio reproducing apparatus according to claim 1, wherein said low pass filter passes frequencies which are at least partially cut off by said high pass filter, said high pass filter passes frequencies which are at least partially cut off by said low pass filter.

3. An audio reproducing apparatus according to claim 1, wherein said speaker unit is included in a speaker box.

4. An audio reproducing apparatus according to claim 3, wherein said first microphone is disposed outside said speaker box and said second microphone is disposed inside said speaker box.

5. An audio reproducing apparatus according to claim 1, further comprising an AC/DC converter for converting said adder result to a DC output signal, wherein said DC output signal is provided to said variable gain circuit to vary said output signal of said variable gain circuit.

6. An audio reproducing apparatus according to claim 3, wherein said first microphone is disposed in front of the speaker unit and said second microphone is disposed behind the speaker unit.

7. An audio reproducing apparatus according to claim 5, wherein said AC/DC converter is a rectifier.

8. An audio reproducing apparatus according to claim 1, wherein said audio reproducing apparatus is situated in a moving vehicle.

* * * * *